US008494187B2

(12) United States Patent
Jiang et al.

(10) Patent No.: US 8,494,187 B2
(45) Date of Patent: Jul. 23, 2013

(54) CARBON NANOTUBE SPEAKER

(75) Inventors: Kai-Li Jiang, Beijing (CN); Liang Liu, Beijing (CN); Chen Feng, Beijing (CN); Li Qian, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 605 days.

(21) Appl. No.: 12/658,551

(22) Filed: Feb. 11, 2010

(65) Prior Publication Data

US 2011/0110535 A1 May 12, 2011

(30) Foreign Application Priority Data

Nov. 6, 2009 (CN) ..... 2009 1 0110047

(51) Int. Cl.
*H04R 25/00* (2006.01)

(52) U.S. Cl.
USPC ..... 381/164; 977/932; 381/426

(58) Field of Classification Search
USPC ..... 381/164; 367/140; 977/742, 932, 977/950; 181/142
See application file for complete search history.

(56) References Cited

U.S. PATENT DOCUMENTS

| | | | |
|---|---|---|---|
| 1,528,774 | A | 3/1925 | Kranz |
| 3,670,299 | A | 6/1972 | Kahn |
| 3,982,143 | A | 9/1976 | Tamura et al. |
| 4,002,897 | A | 1/1977 | Kleinman et al. |
| 4,045,695 | A | 8/1977 | Itagaki et al. |
| 4,334,321 | A | 6/1982 | Edelman |
| 4,503,564 | A | 3/1985 | Edelman et al. |
| 4,641,377 | A | 2/1987 | Rush et al. |
| 4,689,827 | A | 8/1987 | Gurney, Jr. |
| 4,766,607 | A | 8/1988 | Feldman |
| 5,694,477 | A | 12/1997 | Kole |
| 6,307,300 | B1 | 10/2001 | Yamamoto et al. |
| 6,473,625 | B1 | 10/2002 | Williams et al. |
| 6,777,637 | B2 | 8/2004 | Nakayama et al. |
| 6,803,116 | B2 | 10/2004 | Ikeda |
| 6,803,840 | B2 | 10/2004 | Hunt et al. |

(Continued)

FOREIGN PATENT DOCUMENTS

| | | |
|---|---|---|
| CN | 2083373 | 8/1991 |
| CN | 2251746 Y | 4/1997 |

(Continued)

OTHER PUBLICATIONS

Chen, Huxiong; Diebold, Gerald, "Chemical Generation of Acoustic Waves: A Giant Photoacoustic Effect", Nov. 10, 1995, Science, vol. 270, pp. 963-966.

(Continued)

*Primary Examiner* — Mohammad Islam
*Assistant Examiner* — Phylesha Dabney
(74) *Attorney, Agent, or Firm* — Altis Law Group, Inc.

(57) ABSTRACT

A speaker includes an sound wave generator, at least one first electrode, at least one second electrode, an amplifier circuit, and a connector. The at least one first electrode and the at least one second electrode are electrically connected to the sound wave generator. The amplifier is electrically connected to the at least one first electrode and the at least one second electrode. The connector is electrically connected to the amplifier circuit. The sound wave generator includes a carbon nanotube structure and insulative reinforcement structure compounded with the carbon nanotube structure.

18 Claims, 12 Drawing Sheets

U.S. PATENT DOCUMENTS

| | | | | |
|---|---|---|---|---|
| 6,808,746 | B1 | 10/2004 | Dai et al. | |
| 6,864,668 | B1 | 3/2005 | McCune et al. | |
| 6,921,575 | B2 | 7/2005 | Horiuchi et al. | |
| 7,045,108 | B2 | 5/2006 | Jiang et al. | |
| 7,130,436 | B1 | 10/2006 | Tabata et al. | |
| 7,242,250 | B2 | 7/2007 | Tsurumi | |
| 7,315,204 | B2 | 1/2008 | Seven | |
| 7,366,318 | B2 | 4/2008 | Nevill | |
| 7,393,428 | B2 | 7/2008 | Huang et al. | |
| 7,474,590 | B2 | 1/2009 | Watabe et al. | |
| 7,572,165 | B2 | 8/2009 | Liu et al. | |
| 7,723,684 | B1 | 5/2010 | Haddon et al. | |
| 7,799,163 | B1 | 9/2010 | Mau et al. | |
| 8,073,165 | B2 * | 12/2011 | Jiang et al. | 381/164 |
| 8,199,938 | B2 * | 6/2012 | Jiang et al. | 381/164 |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0152238 | A1 | 8/2003 | Daly | |
| 2003/0165249 | A1 | 9/2003 | Higuchi | |
| 2004/0051432 | A1 | 3/2004 | Jiang et al. | |
| 2004/0053780 | A1 | 3/2004 | Jiang et al. | |
| 2004/0070326 | A1 | 4/2004 | Mao et al. | |
| 2004/0119062 | A1 | 6/2004 | Lu et al. | |
| 2005/0006801 | A1 | 1/2005 | Kinloch et al. | |
| 2005/0036905 | A1 | 2/2005 | Gokturk | |
| 2005/0040371 | A1 | 2/2005 | Watanabe et al. | |
| 2005/0129939 | A1 | 6/2005 | Shigematsu et al. | |
| 2005/0201575 | A1 | 9/2005 | Koshida et al. | |
| 2006/0072770 | A1 | 4/2006 | Miyazaki | |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa | |
| 2007/0161263 | A1 | 7/2007 | Meisner | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 | 7/2008 | Zhang et al. | |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2008/0304201 | A1 | 12/2008 | Takao et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2009/0268557 | A1 | 10/2009 | Jiang et al. | |
| 2009/0268562 | A1 | 10/2009 | Jiang et al. | |
| 2010/0054502 | A1 | 3/2010 | Miyachi | |
| 2010/0054507 | A1 | 3/2010 | Oh et al. | |
| 2010/0086166 | A1 | 4/2010 | Jiang et al. | |
| 2010/0166232 | A1 | 7/2010 | Liu et al. | |
| 2010/0233472 | A1 | 9/2010 | Liu et al. | |
| 2011/0171419 | A1 | 7/2011 | Li et al. | |

FOREIGN PATENT DOCUMENTS

| | | | |
|---|---|---|---|
| CN | 2282750 | Y | 5/1998 |
| CN | 2302622 | | 12/1998 |
| CN | 2327142 | | 6/1999 |
| CN | 1239394 | | 12/1999 |
| CN | 1265000 | | 8/2000 |
| CN | 2425468 | | 3/2001 |
| CN | 2485699 | Y | 4/2002 |
| CN | 1407392 | | 4/2003 |
| CN | 1443021 | | 9/2003 |
| CN | 1629627 | | 6/2005 |
| CN | 1691246 | | 11/2005 |
| CN | 1698400 | | 11/2005 |
| CN | 1698400 | A | 11/2005 |
| CN | 1711620 | A | 12/2005 |
| CN | 2779422 | Y | 5/2006 |
| CN | 1787696 | | 6/2006 |
| CN | 2787870 | | 6/2006 |
| CN | 2798479 | | 7/2006 |
| CN | 1821048 | | 8/2006 |
| CN | 1886820 | | 12/2006 |
| CN | 1944829 | | 4/2007 |
| CN | 1982209 | | 6/2007 |
| CN | 1997243 | | 7/2007 |
| CN | 101239712 | | 8/2008 |
| CN | 101284662 | | 10/2008 |
| CN | 201150134 | | 11/2008 |
| CN | 101314464 | | 12/2008 |
| CN | 101437663 | | 5/2009 |
| CN | 101458221 | A | 6/2009 |
| CN | 101471213 | | 7/2009 |
| CN | 101715155 | | 5/2010 |
| CN | 101400198 | | 9/2010 |
| DE | 102005059270 | | 6/2007 |
| JP | 49-24593 | | 3/1974 |
| JP | 58-9822 | | 1/1983 |
| JP | 58-19491 | | 2/1983 |
| JP | 60-22900 | | 2/1985 |
| JP | 61-294786 | | 12/1986 |
| JP | 1-255398 | | 10/1989 |
| JP | 3-147497 | | 6/1991 |
| JP | 4-126489 | | 4/1992 |
| JP | 6-33390 | | 4/1994 |
| JP | 7-282961 | | 10/1995 |
| JP | 8-20868 | | 1/1996 |
| JP | 9-105788 | | 4/1997 |
| JP | 11-282473 | | 10/1999 |
| JP | 11-300274 | | 11/1999 |
| JP | 2001333493 | | 11/2001 |
| JP | 2002-186097 | | 6/2002 |
| JP | 2002-352940 | | 12/2002 |
| JP | 2002346996 | | 12/2002 |
| JP | 2002542136 | | 12/2002 |
| JP | 2003500325 | | 1/2003 |
| JP | 2003-154312 | | 5/2003 |
| JP | 2003198281 | | 7/2003 |
| JP | 2003-266399 | | 9/2003 |
| JP | 2003-319490 | | 11/2003 |
| JP | 2003-319491 | | 11/2003 |
| JP | 2003-332266 | | 11/2003 |
| JP | 2003-343867 | | 12/2003 |
| JP | 20042103 | | 1/2004 |
| JP | 2004-107196 | | 4/2004 |
| JP | 2004229250 | | 8/2004 |
| JP | 2005-20315 | | 1/2005 |
| JP | 2005-51284 | | 2/2005 |
| JP | 2005-73197 | | 3/2005 |
| JP | 2005-97046 | | 4/2005 |
| JP | 2005189322 | | 7/2005 |
| JP | 2005-235672 | | 9/2005 |
| JP | 2005-318040 | | 11/2005 |
| JP | 2005-534515 | | 11/2005 |
| JP | 2005-341554 | | 12/2005 |
| JP | 2005333601 | | 12/2005 |
| JP | 2006-93932 | | 4/2006 |
| JP | 2006-180082 | | 7/2006 |
| JP | 2006-202770 | | 8/2006 |
| JP | 2006-217059 | | 8/2006 |
| JP | 2006270041 | | 10/2006 |
| JP | 2007-24688 | | 2/2007 |
| JP | 2007-54831 | | 3/2007 |
| JP | 2007-167118 | | 7/2007 |
| JP | 2007-174220 | | 7/2007 |
| JP | 2007-187976 | | 7/2007 |
| JP | 2007-196195 | | 8/2007 |
| JP | 2007-228299 | | 9/2007 |
| JP | 2007-527099 | | 9/2007 |
| JP | 2008-62644 | | 3/2008 |
| JP | 2008-101910 | | 5/2008 |

| | | |
|---|---|---|
| JP | 2008-153042 | 7/2008 |
| JP | 2008-163535 | 7/2008 |
| JP | 2008-269914 | 11/2008 |
| JP | 2009-31031 | 2/2009 |
| JP | 2009-91239 | 4/2009 |
| JP | 2009-94074 | 4/2009 |
| JP | 200994074 | 4/2009 |
| JP | 2009-146896 | 7/2009 |
| JP | 2009-146898 | 7/2009 |
| JP | 2009-164125 | 7/2009 |
| JP | 2009-184907 | 8/2009 |
| JP | 2009-184908 | 8/2009 |
| KR | 10-0761548 | 9/2007 |
| TW | 432780 | 5/2001 |
| TW | 568882 | 1/2004 |
| TW | 200603400 | 1/2006 |
| TW | I248253 | 1/2006 |
| TW | 200726290 | 7/2007 |
| TW | 200740976 | 11/2007 |
| TW | 200744399 | 12/2007 |
| TW | 200829675 | 7/2008 |
| TW | 200833862 | 8/2008 |
| TW | 200950569 | 12/2009 |
| TW | 201029481 | 8/2010 |
| WO | WO0073204 | 12/2000 |
| WO | WO2004012932 | 2/2004 |
| WO | WO2005102924 | 11/2005 |
| WO | WO2005120130 | 12/2005 |
| WO | WO2007043837 | 4/2007 |
| WO | WO2007049496 | 5/2007 |
| WO | WO2007052928 | 5/2007 |
| WO | WO2007099975 | 9/2007 |
| WO | WO2007111107 | 10/2007 |
| WO | WO2008/029451 | 3/2008 |

OTHER PUBLICATIONS

Amos, S.W.; "Principles of Transistor Circuits"; 2000; Newnes-Butterworth-Heinemann; 9th ed.;p. 114.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

Swift Gregory W., Thermoacoustic Engines and Refrigerators, Physics Today, Jul. 1995, pp. 22-28, vol. 48.

Kaili Jiang, Qunqing Li, Shoushan Fan, Spinning continuous carbon nanotube yarns, Nature, Oct. 24, 2002, pp. 801, vol. 419.

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

W. Yi, L.Lu, Zhang Dianlin et al., Linear Specific Heat of Carbon Nanotubes, Physical Review B, Apr. 1, 1999, vol. 59, No. 14, R9015-9018.

Zhuangchun Wu, Zhihong Chen, Xu Du et al.,Transparent, Conductive Carbon Nanotube Films, Science, Aug. 27, 2004, pp. 1273-1276, vol. 305.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

Strutt John William, Rayleigh Baron, The Theory of Sound, 1926, pp. 226-235, vol. 2.

H.D. Arnold, I.B. Crandall, The Thermophone as a Precision Source of Sound, Physical Review, 1917, pp. 22-38, vol. 10.

P. De Lange, On Thermophones, Proceedings of the Royal Society of London. Series A, Apr. 1, 1915, pp. 239-241, vol. 91, No. 628.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Braun Ferdinand, Notiz uber Thermophonie, Ann. Der Physik, Apr. 1898, pp. 358-360,vol. 65.

Frank P. Incropera, David P. Dewitt et al., Fundamentals of Heat and Mass Transfer, 6th ed., 2007, pp. A-5, Wiley:Asia.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Edward C. Wente, The Thermophone, Physical Review, 1922, pp. 333-345,vol. 19.

William Henry Preece, On Some Thermal Effects of Electric Currents, Proceedings of the Royal Society of London, 1879-1880, pp. 408-411, vol. 30.

J.J.Hopfield, Spectra of Hydrogen, Nitrogen and Oxygen in the Extreme Ultraviolet, Physical Review, 1922, pp. 573-588,vol. 20.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

http://www.physorg.com/news123167268.html.

Lin Xiao et al., "Flexible, stretchable, transparent carbon nanotube thin film loudspeakers" vol. 8, No. 12, pp. 4539-4545 ,2008.

Arnold et al., "The thermophone as a precision source of sound", Phys. Rev. 10, pp. 22-38 (1917).

Fan et al., "Flexible, Stretchable, Transparent Carbon Nanotube Thin Film Loudspeakers", Nano Letters, vol. 8 (12), 4539-4545 (2008).

F. Kontomichos et al ., "A thermoacoustic device for sound reproduction", acoustics 08' Paris, Jun. 29-Jul. 4, 2008.

P.M. Ajayan et al., "Nanotubes in a flash-Ignition and reconstruction", Science, vol. 296, pp. 705, Apr. 26, 2002.

F.Kontomichos et al., "A thermoacoustic device for sound reproduction", acoustics 08 Paris, pp. 4349-4353, Jun. 29-Jul. 4, 2008.

Silvanus P. Thompson, The Photophone, Nature, 23, Sep. 1880, vol. XXII, No. 569, pp. 481.

Lee et al., Photosensitization of nonlinear scattering and photoacoustic emission from single-walled carbon nanotubes, Applied Physics Letters, 13, Mar. 2008, 92, 103122.

Alexander Graham Bell, Selenium and the Photophone, Nature, Sep. 23, 1880, pp. 500-503.

* cited by examiner

CARBON NANOTUBE SPEAKER

RELATED APPLICATIONS

This application claims all benefits accruing under 35 U.S.C. §119 from China Patent Application No. 200910110047.2, filed on Nov. 6, 2009 in the China Intellectual Property Office.

BACKGROUND

1. Technical Field

The present disclosure relates to a speaker based on carbon nanotubes.

2. Description of Related Art

In traditional speakers, sounds are produced by mechanical movement of one or more diaphragms.

In one article, entitled "The thermophone as a precision source of sound" by H. D. Arnold and I. B. Crandall, Phys. Rev. 10, pp 22-38 (1917), a thermophone based on the thermoacoustic effect is disclosed. The thermophone in the article includes a platinum strip used as sound wave generator and two terminal clamps. The two terminal clamps are located apart from each other, and are electrically connected to the platinum strip. The platinum strip has a thickness of 0.7 micrometers. Frequency response range and sound pressure of sound wave are closely related to the heat capacity per unit area of the platinum strip. The higher the heat capacity per unit area, the narrower the frequency response range and the weaker the sound pressure. It's very difficult to produce an extremely thin metal strip such as platinum strip. For example, the platinum strip has a heat capacity per unit area higher than $2\times10^{-4}$ J/cm$^2$*K. The highest frequency response of the platinum strip is only $4\times10^3$ Hz, and the sound pressure produced by the platinum strip is also too weak and is difficult to be heard by human.

In another article, entitled "Flexible, Stretchable, Transparent Carbon Nanotube Thin Film Loudspeakers" by Fan et al., Nano Letters, Vol. 8 (12), 4539-4545 (2008), a carbon nanotube speaker is disclosed. The carbon nanotube speaker includes an sound wave generator. The sound wave generator is a carbon nanotube film. The carbon nanotube speaker can produce a sound that can be heard by humans because of a large specific surface area and small heat capacity per unit area of the carbon nanotube film. The frequency response range of the carbon nanotube speaker can range from about 100 Hz to about 100 KHz. However, carbon nanotube speakers are easily damaged because the strength of the carbon nanotube film is relatively low.

What is needed, therefore, is to provide a carbon nanotube speaker which has a relatively high strength.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
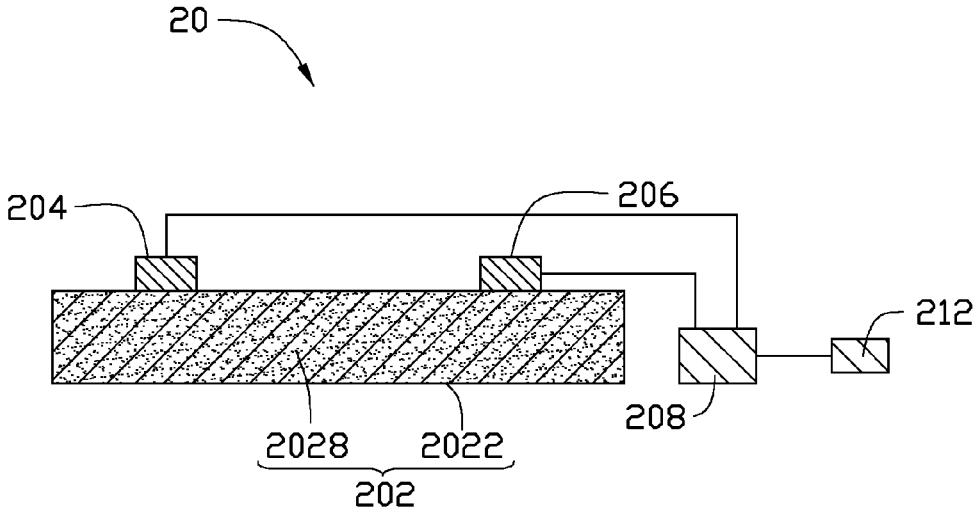
FIG. 1 is a schematic view of one embodiment of a speaker.

Referring to FIG. 1, a speaker 20 of one embodiment is shown. The speaker 20 includes an sound wave generator 202, at least one first electrode 204, at least one second electrode 206, an amplifier circuit 208, and a connector 212.

The sound wave generator 202 includes a carbon nanotube structure 2022 and an insulative reinforcement structure 2028 compounded with the carbon nanotube structure 2022. The carbon nanotube structure 2022 can be a free-standing structure, that is, the carbon nanotube structure 2022 can be supported by itself and does not need a substrate to provide support. When holding at least a point of the carbon nanotube structure, the entire carbon nanotube structure can be lifted without destroyed. The carbon nanotube structure 2022 includes a plurality of carbon nanotubes joined by van der Waals attractive force therebetween. The carbon nanotube structure 2022 can be a substantially pure structure of the carbon nanotubes, with few impurities. As the carbon nanotube has large specific surface area, the carbon nanotube structure 2022 with a plurality of carbon nanotubes has large specific surface area. So there is a great contact between the structure 2028 and the carbon nanotube structure 2022. The carbon nanotube structure 2022 is flexible and can be folded into any shape. The carbon nanotubes can be used to form many different structures and provide a large specific surface area. The heat capacity per unit area of the carbon nanotube structure 2022 can be less than $2\times10^{-4}$ J/m$^2$*K. In one embodiment, the heat capacity per unit area of the carbon nanotube structure 2022 is less than or equal to $1.7\times10^{-6}$ J/m$^2$*K.

The carbon nanotubes in the carbon nanotube structure 2022 can be arranged orderly or disorderly. The term 'disordered carbon nanotube structure' includes, but is not limited to, a structure where the carbon nanotubes are arranged along different directions, and the aligning directions of the carbon nanotubes are random. The number of the carbon nanotubes arranged along each different direction can be almost the same (e.g. uniformly disordered). The disordered carbon nanotube structure can be isotropic, namely the carbon nanotube film has properties identical in all directions of the carbon nanotube film. The carbon nanotubes in the disordered carbon nanotube structure can be entangled with each other.

The carbon nanotube structure 2022 including ordered carbon nanotubes is an ordered carbon nanotube structure. The term 'ordered carbon nanotube structure' includes, but is not limited to, a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions). The carbon nanotubes in the carbon nanotube structure 2022 can be single-walled, double-walled, or multi-walled carbon nanotubes.

The carbon nanotube structure 2022 can be a carbon nanotube film structure with a thickness ranging from about 0.5 nanometers (nm) to about 1 mm. The carbon nanotube film structure can include at least one carbon nanotube film. When the carbon nanotube film structure includes a plurality of carbon nanotube films, the plurality of carbon nanotube films can be coplanar or stacked with each other. The carbon nanotube structure 2022 can also be at least one linear carbon nanotube structure with a diameter ranging from about 0.5 nm to about 1 mm. When the carbon nanotube structure 2022 includes a single linear carbon nanotube structure, the single linear carbon nanotube structure can be folded or winded to form a planar structure. When the carbon nanotube structure 2022 includes a plurality of linear carbon nanotube structures, the plurality of linear carbon nanotube structures can be parallel with each other, crossed with each other, or weaved together with each other to form a planar structure. The carbon nanotube structure 2022 can also be a combination of the carbon nanotube film structure and the linear carbon nanotube structure. It is understood that any carbon nanotube structure 2022 described can be used with all embodiments. It is also understood that any carbon nanotube structure 2022 may or may not employ a support structure.

Carbon Nanotube Film Structure

In one embodiment, the carbon nanotube film structure includes at least one drawn carbon nanotube film. A film can be drawn from a carbon nanotube array, to obtain a drawn carbon nanotube film. Examples of drawn carbon nanotube film are taught by U.S. Pat. No. 7,045,108 to Jiang et al., and WO 2007015710 to Zhang et al.

The carbon nanotube drawn film includes a plurality of carbon nanotubes that can be arranged substantially parallel to a surface of the carbon nanotube drawn film. A large number of the carbon nanotubes in the carbon nanotube drawn film can be oriented along a preferred orientation, meaning that a large number of the carbon nanotubes in the carbon nanotube drawn film are arranged substantially along the same direction. An end of one carbon nanotube is joined to another end of an adjacent carbon nanotube arranged substantially along the same direction, by van der Waals attractive force. A small number of the carbon nanotubes are randomly arranged in the carbon nanotube drawn film, and has a small if not negligible effect on the larger number of the carbon nanotubes in the carbon nanotube drawn film arranged substantially along the same direction. The carbon nanotube film is capable of forming a free-standing structure. The term "free-standing structure" can be defined as a structure that does not have to be supported by a substrate. For example, a free standing structure can sustain the weight of itself when it is hoisted by a portion thereof without any significant damage to its structural integrity. So, if the carbon nanotube drawn film is placed between two separate supporters, a portion of the carbon nanotube drawn film, not in contact with the two supporters, would be suspended between the two supporters and yet maintain film structural integrity. The free-standing structure of the carbon nanotube drawn film is realized by the successive carbon nanotubes joined end to end by van der Waals attractive force.

Figure 2:
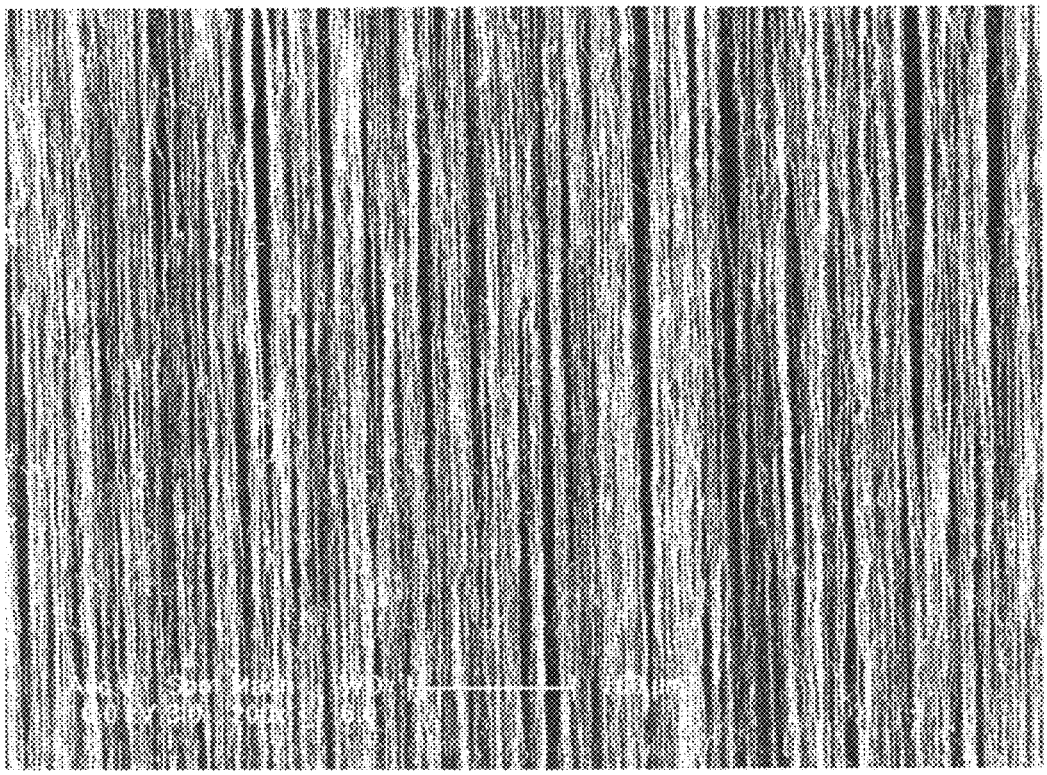
FIG. 2 is a Scanning Electron Microscope (SEM) image of a drawn carbon nanotube film.
Figure 3:
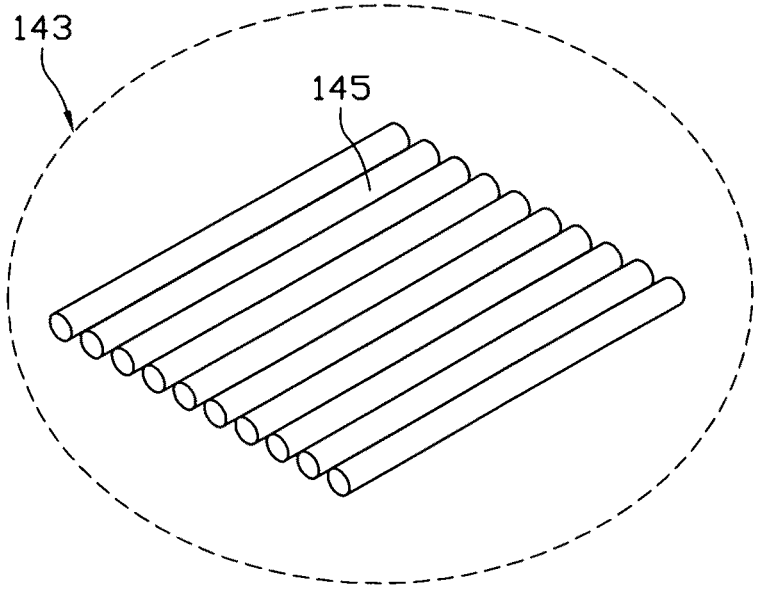
FIG. 3 is a schematic view of a carbon nanotube segment in the drawn carbon nanotube film of FIG. 2.

It can be appreciated that some variation can occur in the orientation of the carbon nanotubes in the carbon nanotube drawn film as can be seen in FIG. 2. Microscopically, the carbon nanotubes oriented substantially along the same direction may not be perfectly aligned in a straight line, and some curve portions may exist. It can be understood that some carbon nanotubes located substantially side by side and oriented along the same direction being contact with each other can not be excluded. More specifically, referring to FIG. 3, the carbon nanotube drawn film includes a plurality of successively oriented carbon nanotube segments 143 joined end-to-end by van der Waals attractive force therebetween. Each carbon nanotube segment 143 includes a plurality of carbon nanotubes 145 substantially parallel to each other, and joined by van der Waals attractive force therebetween. The carbon nanotube segments 143 can vary in width, thickness, uniformity and shape. The carbon nanotubes 145 in the carbon nanotube drawn film 143 are also substantially oriented along a preferred orientation.

The carbon nanotube film structure of the sound wave generator 202 can include at least two stacked carbon nanotube films. In other embodiments, the carbon nanotube structure can include two or more coplanar carbon nanotube films, and can include layers of coplanar carbon nanotube films. Additionally, when the carbon nanotubes in the carbon nanotube film are aligned along one preferred orientation (e.g., the drawn carbon nanotube film), an angle can exist between the orientations of carbon nanotubes in adjacent films, whether stacked or adjacent. Adjacent carbon nanotube films can be combined by only the van der Waals attractive force therebetween. The number of the layers of the carbon nanotube films is not limited. However, the thicker the carbon nanotube structure, the specific surface area will decrease. An angle between the aligned directions of the carbon nanotubes in two adjacent carbon nanotube films can range from about 0 degrees to about 90 degrees. When the angle between the aligned directions of the carbon nanotubes in adjacent carbon nanotube films is larger than 0 degrees, a microporous structure is defined by the carbon nanotubes in the sound wave generator 202. The carbon nanotube structure in an embodiment employing these films will have a plurality of micropores. Stacking the carbon nanotube films will also add to the structural integrity of the carbon nanotube structure.

Figure 4:
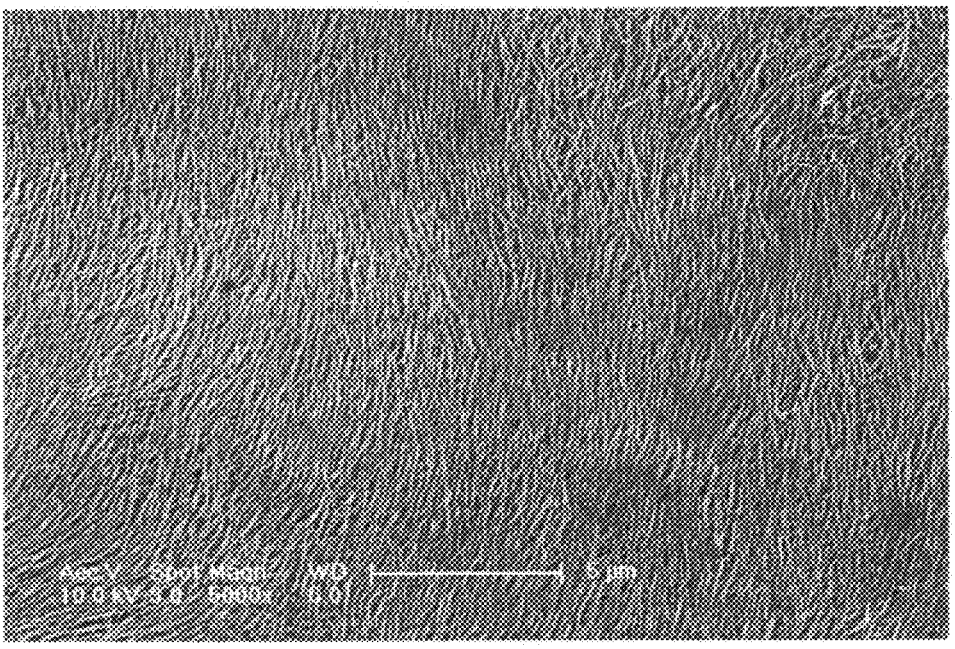
FIG. 4 is an SEM image of a pressed carbon nanotube film having a plurality of carbon nanotubes substantially arranged along a same direction.
Figure 5:
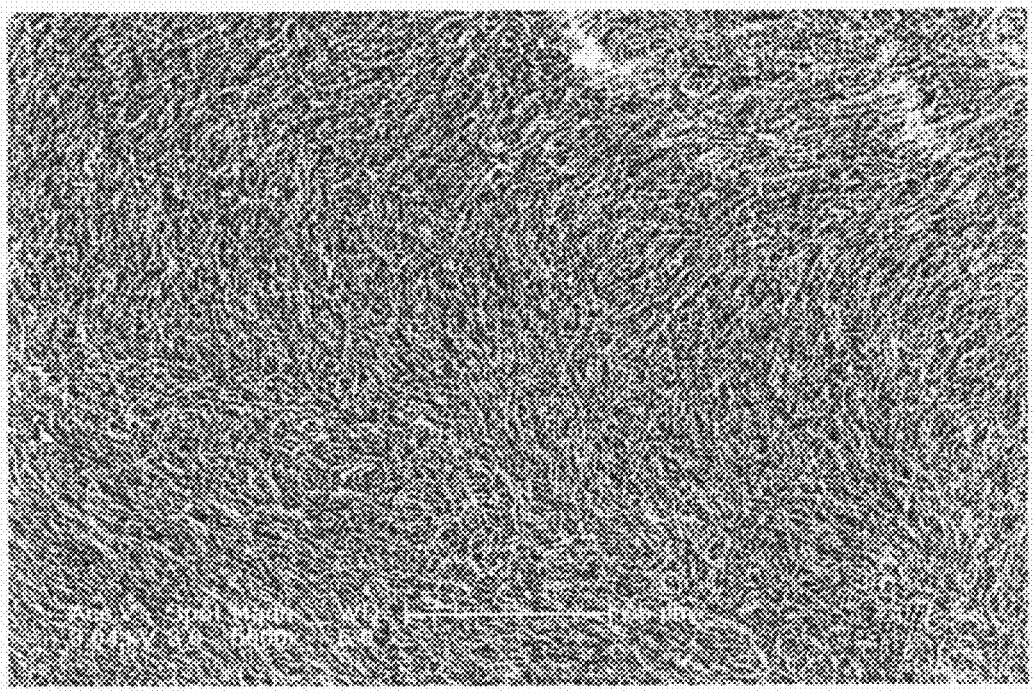
FIG. 5 is an SEM image of a pressed carbon nanotube film having a plurality of carbon nanotubes arranged along different directions.

In other embodiments, the carbon nanotube film structure can include at least a pressed carbon nanotube film. Referring to FIGS. 4 and 5, the pressed carbon nanotube film can be a free-standing carbon nanotube film. The carbon nanotubes in the pressed carbon nanotube film are arranged along a same direction or along different directions. When the pressed carbon nanotube film includes two or more sections, the carbon nanotubes in the two or more sections are arranged along two or more different directions. The carbon nanotubes in each of the sections are arranged approximately along the same direction and the carbon nanotubes in different sections are arranged approximately along the different directions. The carbon nanotubes in the pressed carbon nanotube film can rest upon each other. Adjacent carbon nanotubes are attracted to each other and combined by van der Waals attractive force. An angle between a primary alignment direction of the carbon nanotubes and a surface of the pressed carbon nanotube film is about 0 degrees to approximately 15 degrees. The greater the pressure applied, the smaller the angle obtained. When the carbon nanotubes in the pressed carbon nanotube film are arranged along different directions, the carbon nanotube structure can be isotropic. The pressed carbon nanotube film has properties identical in all directions parallel to a surface of the carbon nanotube film. The thickness of the pressed carbon nanotube film ranges from about 0.5 nm to about 1 mm. Examples of pressed carbon nanotube film are taught by US PGPub. 20080299031A1 to Liu et al.

Figure 6:
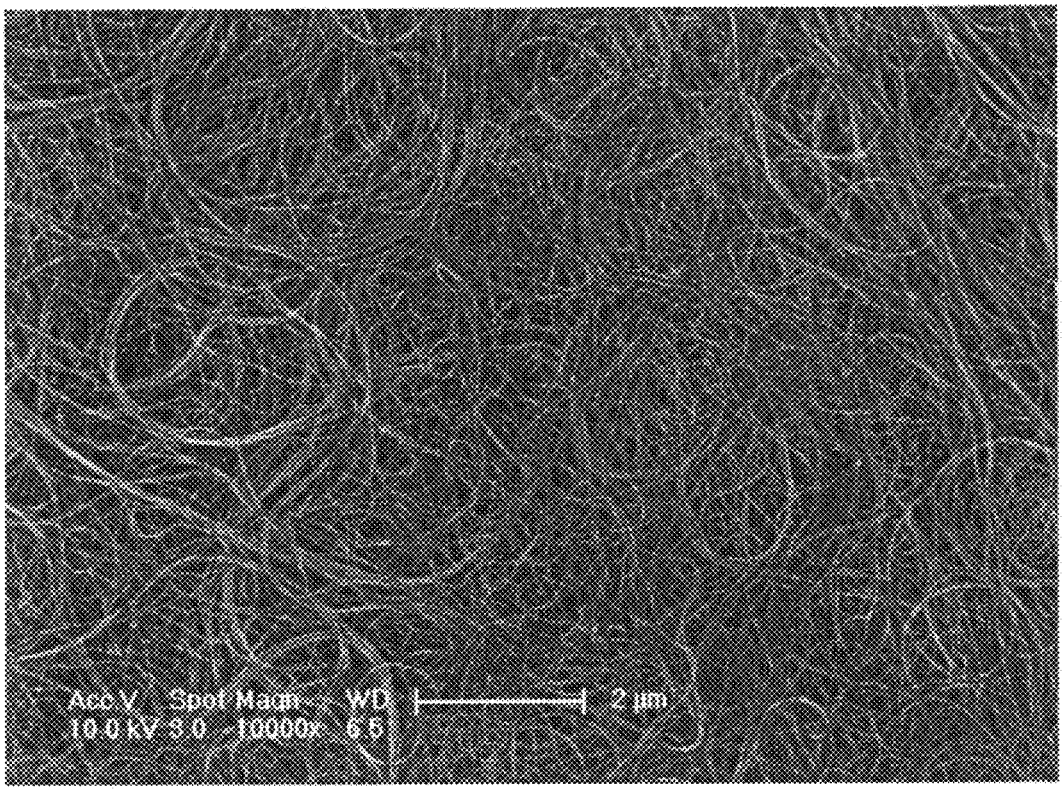
FIG. 6 is an SEM image of a flocculated carbon nanotube film.

In other embodiments, the carbon nanotube film structure includes a flocculated carbon nanotube film. Referring to FIG. 6, the flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to obtain an entangled structure with micropores defined therein. It is understood that the flocculated carbon nanotube film is very porous, and can have a pore size that is so fine that a particle with an effective diameter greater than 10 μm cannot pass the micropores. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of the carbon nanotube structure. The flocculated carbon nanotube film is a free-standing structure due to the carbon nanotubes being entangled and adhered together by van der Waals attractive force therebetween. The thickness of the flocculated carbon nanotube film can range from about 0.5 nm to about 1 mm.

Linear Carbon Nanotube Structure

Figure 7:
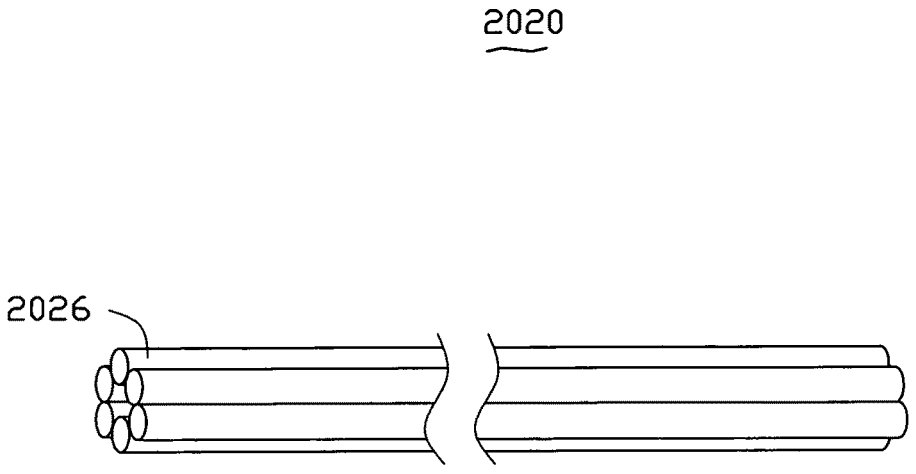
FIG. 7 is an SEM image of an untwisted carbon nanotube wire.
Figure 8:
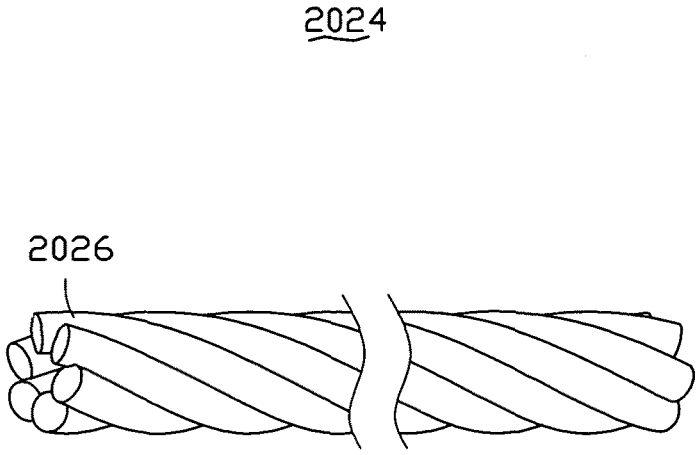
FIG. 8 is an SEM image of a twisted carbon nanotube wire.

In other embodiments, the linear carbon nanotube structure includes carbon nanotube wires and/or carbon nanotube cables. The carbon nanotube cable can include one or more carbon nanotube wires. The carbon nanotube wires in the carbon nanotube cable can be, twisted and/or untwisted. Referring to FIG. 7, in an untwisted carbon nanotube cable 2020, the carbon nanotube wires 2026 are parallel with each other, and the axes of the nanotube wires 2026 extend along a same direction. Referring to FIG. 8, in a twisted carbon nanotube cable 2024, carbon nanotube wires 2026 are twisted with each other.

Figure 9:
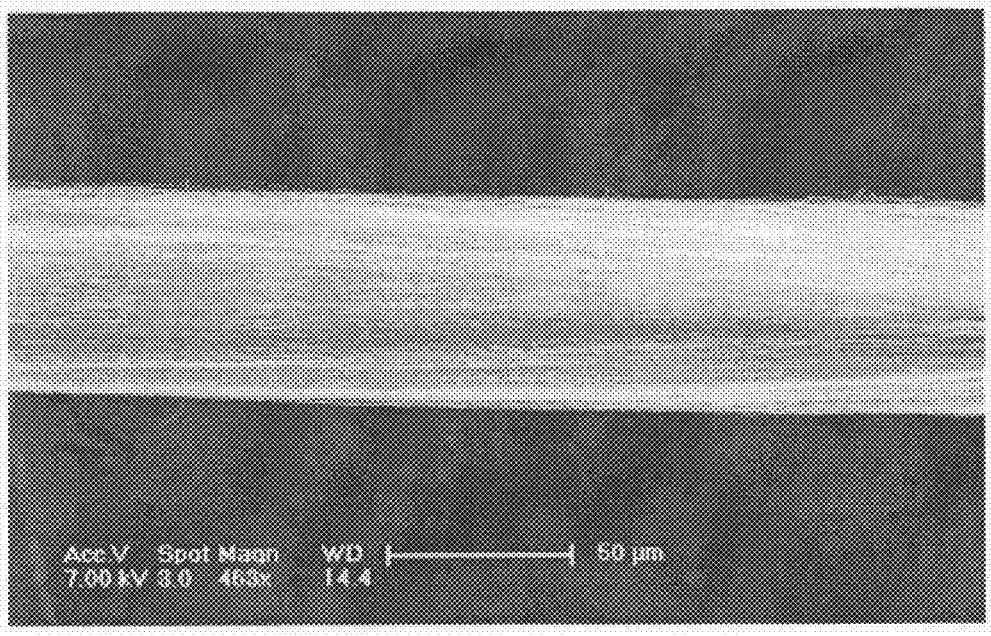
FIG. 9 is a schematic view of an untwisted carbon nanotube cable having a plurality of carbon nanotube wires parallel with each other.

The carbon nanotube wire can be untwisted or twisted. Treating the drawn carbon nanotube film with a volatile organic solvent can obtain the untwisted carbon nanotube wire. In one embodiment, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into an untwisted carbon nanotube wire. Referring to FIG. 9, the untwisted carbon nanotube wire, includes a plurality of carbon nanotubes substantially oriented along a same direction (i.e., a direction along the length direction of the untwisted carbon nanotube wire). The carbon nanotubes are parallel to the axis of the untwisted carbon nanotube wire. In one embodiment, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nm to about 100 μm.

Figure 10:
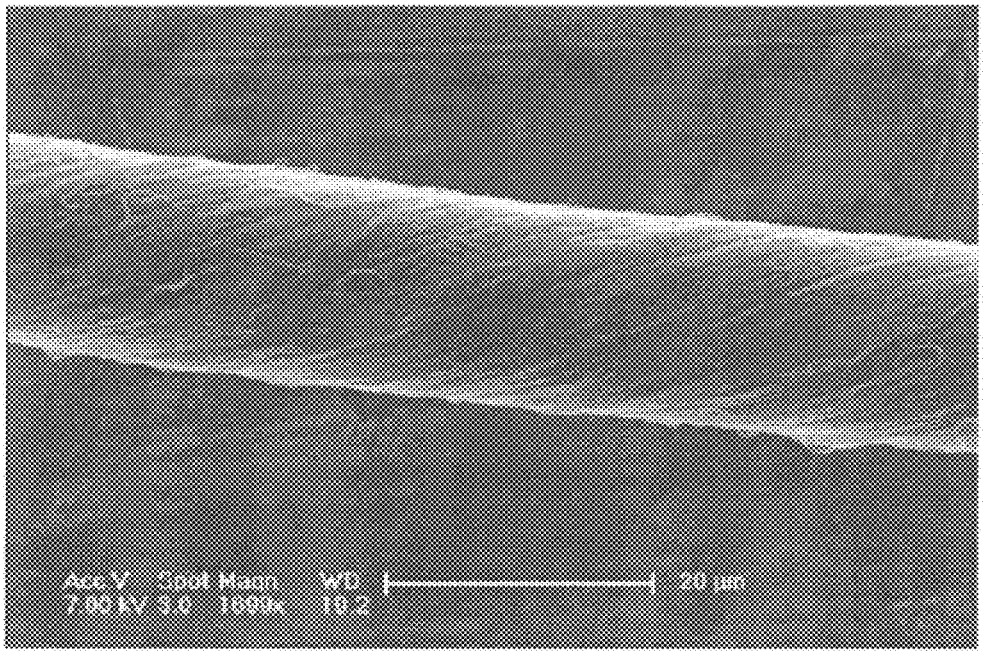
FIG. 10 is a schematic view of a twisted carbon nanotube cable having a plurality of carbon nanotube wires twisted with each other.

The twisted carbon nanotube wire can be obtained by twisting a drawn carbon nanotube film using a mechanical force to turn the two ends of the drawn carbon nanotube film in opposite directions. Referring to FIG. 10, the twisted carbon nanotube wire includes a plurality of carbon nanotubes helically oriented around an axial direction of the twisted carbon nanotube wire. In one embodiment, the twisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease, while the density and strength of the twisted carbon nanotube wire will be increased.

The structure 2028 can be made of glass, metallic oxide, resin or ceramic. In one embodiment, the structure 2028 can be a plurality of particles dispersed in the micropores of the carbon nanotube structure 2022. The structure 2028 can be dispersed in the gaps between the carbon nanotubes and/or on a surface of the carbon nanotubes. The effective diameters of the particles can range from about 1 nm to about 500 nm. In one embodiment, the effective diameters of the particles can range from about 50 nm to about 100 nm. The particles can be deposited in the gaps between the carbon nanotubes and/or on a surface of the carbon nanotubes by sputtering. The carbon nanotube structure 2022 and structure 2028 can form a composite. The structure 2028 can add support to the attractive forces between the adjacent carbon nanotubes so that the strength of the carbon nanotube structure 2022 is increased.

In one embodiment, the speaker 20 includes only one first electrode 204 and only one second electrode 206 as shown in FIG. 1. The first electrode 204 and the second electrode 206 are located on a surface of the sound wave generator 202 and electrically connected to the sound wave generator 202. Furthermore, it is imperative that the first electrode 204 can be separated from the second electrode 206 to prevent short circuit of the two electrodes 204, 206. The shape of the first electrode 204 or the second electrode 206 is not limited and can be lamellar, rod, wire, and block among other shapes. In one embodiment shown in FIG. 1, the first electrode 204 and the second electrode 206 are both lamellar and parallel with each other. The material of the first electrode 204 and the second electrode 206 can be metals, conductive resins, carbon nanotube, indium tin oxides (ITO), conductive paste or any other suitable materials. In one embodiment, each of the first electrode 204 and the second electrode 206 is a palladium film deposited on a surface of the sound wave generator 202.

Alternatively, the speaker 20 can include a plurality of first electrodes 204 and a plurality of second electrodes 206. The plurality of first electrodes 204 and the plurality of second electrodes 206 are located alternately. The plurality of first electrodes 204 are electrically connected to each other in parallel, and the plurality of second electrodes 206 are electrically connected to each other in parallel. It is understood that the plurality of first electrodes 204 and the plurality of second electrodes 206 can be alternately located in different planes, the sound wave generator 202 can be wrapped around the plurality of first electrodes 204 and the plurality of second electrodes 206 to form a three dimensional structure.

The amplifier circuit 208 is electrically connected to the first electrode 204 and the second electrode 206 and employed for amplifying the audio signals input from the connector 212. The amplifier circuit 208 is an integrated circuit. The connector 212 is electrically connected to the amplifier circuit 208 and employed for inputting audio signal thereto. The connector 212 can be plugs, sockets, or elastic contact pieces. In one embodiment, the connector 212 is a socket.

In use, the amplifier circuit 208 is electrically connected to a power source (not shown). The connector 212 is connected to an audio signals generator (not shown). The audio signals are input by the signals generator to the amplifier circuit 208 via the connector 212. The audio signals are amplified by the amplifier circuit 208 and sent to the sound wave generator 202. Because the carbon nanotube structure 2022 comprises a plurality of carbon nanotubes and has a small heat capacity per unit area (less than less than $2\times10^{-4}$ J/m$^2$*K), the carbon nanotube structure 2022 can transform the audio signals to heat and heat a surrounding medium according to the variations of the audio signal strength. Thus, temperature waves, which are propagated into the medium, are obtained. The temperature waves produce pressure waves in the medium, resulting in sound waves generation. In this process, it is the thermal expansion and contraction of the medium in the vicinity of the carbon nanotube structure 2022 that produces sound waves. This is distinct from the mechanism of the conventional loudspeaker, in which the pressure waves are created by the mechanical movement of the diaphragm. When the input signals are electrical signals, the operating principle of the speaker 20 is an "electrical-thermal-sound" conversion. This heat causes detectable sound waves due to pressure variation in the medium.

Figure 11:
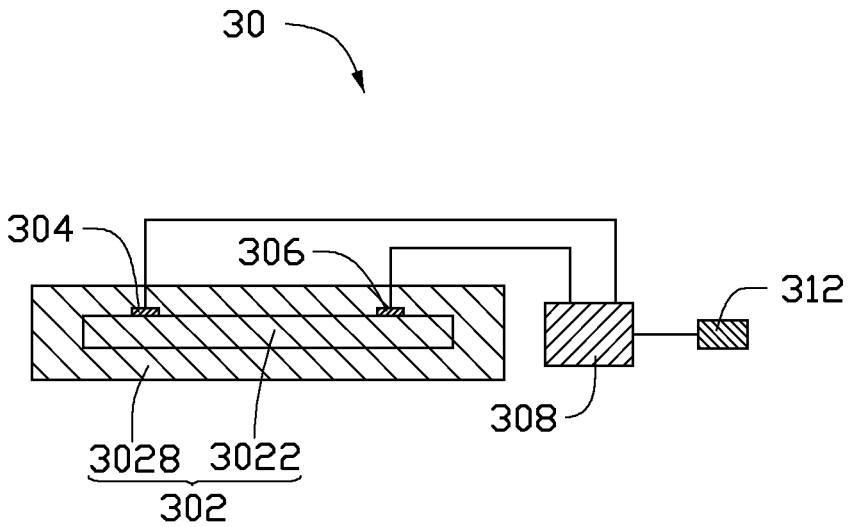
FIG. 11 is a schematic view of another embodiment of a speaker.

Referring to FIG. 11, a speaker 30 according to one embodiment is shown. The speaker 30 includes an sound wave generator 302, a first electrode 304, a second electrode 306, an amplifier circuit 308 and a connector 312.

The sound wave generator 302 includes a carbon nanotube structure 3022 and an insulative reinforcement structure 3028. The speaker 30 is similar to the speaker 20 discussed above except that the structure 3028 encloses the entire carbon nanotube structure 3022 therein. Furthermore, the structure 3028 can penetrate into the carbon nanotube structure 3022.

In one embodiment, the structure 3028 can enclose the entire carbon nanotube structure 3022 and the two electrodes 304, 306. The amplifier circuit 308 and the connector 312 can be located outside of the structure 3028 or be enclosed in the structure 3028. When the connector 312 is enclosed in the structure 3028, the input port (not shown) of the connector 312 should be exposed.

The structure 3028 enclosing the carbon nanotube structure 3022 can be of any shape. In one embodiment, the structure 3028 is a planar structure. The thickness of the planar structure 3028 should be as thin as possible so that the heat capacity per unit area is as small as the heat capacity per unit area of the carbon nanotube structure 3022. The thickness of the planar structure 3028 can range from about 10 nm to about 200 μm. In one embodiment, the thickness of the planar structure 3028 can range from about 50 nm to about 200 nm. The sheet resistance of planar structure 3028 should be great enough so that the two electrodes 304, 306 will not short. The sheet resistance of planar structure 3028 can range from about 1000 ohms per square to about 2000 ohms per square. The thermal conductivity of the planar structure 3028 should be as great as possible so that the heat produced by the carbon nanotube structure 3022 can be transferred to the surrounding medium via the planar structure 3028 as soon as possible. The planar structure 3028 can be made of high temperature resistant resin with a melting point above 100° C.

In one embodiment, the carbon nanotube structure 3022 is a drawn carbon nanotube film with a thickness of 30 nm. The first electrode 304 and the second electrode 306 are palladium film with a thickness of 20 nm. The planar structure 3028 is a high temperature resistant epoxy resin layer with a thickness of 100 nm. The planar structure 3028 encloses the carbon nanotube structure 3022 and the two electrodes 304, 306. The two electrodes 304, 306 are electrically connected to the amplifier circuit 308 via two lead wires (not shown).

The planar structure 3028 can be formed by hot press two epoxy resin sheets disposed on opposite sides of the carbon nanotube structure 3022 or immersing the carbon nanotube structure 3022 in a liquid-state epoxy resin. In one embodiment, a method for making the sound wave generator 302 includes the steps of: (a) depositing two palladium films on a surface of a drawn carbon nanotube film by sputtering; (b) providing a liquid-state epoxy resin and immersing the drawn carbon nanotube film in the liquid-state epoxy resin; and (c) solidifying the liquid-state epoxy resin to form a planar structure 3028.

In use, when audio signals are supplied to the sound wave generator 302, the carbon nanotube structure 3022 can produce heat and heat a surrounding medium via the planar structure 3028. The planar structure 3028 will help to protect and prevent the carbon nanotube structure 3022 from being damaged. When the planar structure 3028 is flexible, the speaker 30 is flexible.

Figure 12:
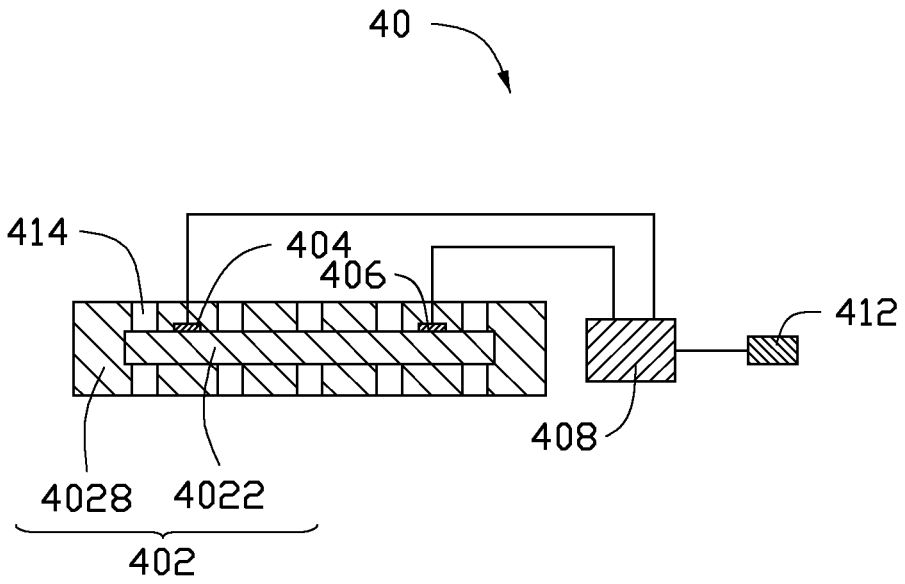
FIG. 12 is a schematic view of another embodiment of a speaker.

Referring to FIG. 12, a speaker 40 according to one embodiment is shown. The speaker 40 includes an sound wave generator 402, a first electrode 404, a second electrode 406, an amplifier circuit 408 and a connector 412.

The sound wave generator 402 includes a carbon nanotube structure 4022 and planar insulative reinforcement structure 4028. The speaker 40 is similar to the speaker 30 discussed above except that the structure 4028 further defines a plurality of openings 414. The openings 414 can be a blind hole or a through hole. The blind hole can extend from a surface of the planar structure 4028 to a surface of the carbon nanotube structure 4022. The through hole can extend from a surface of the planar structure 4028 to the opposite surface of the planar structure 4028. The shape of the openings 414 is arbitrary. The effective diameter of the openings 414 can range from about 10 μm to about 1 centimeter (cm). Because part of the carbon nanotube structure 4022 can be exposed to the surrounding medium via the openings 414, part of the heat produced by the carbon nanotube structure 4022 can be transferred directly to the surrounding medium. Thus the efficiency of heat dissipation of the speaker 40 is increased. The planar structure 4028 can prevent the carbon nanotube structure 4022 from being damaged because of protection provided by a wall of the openings 414.

It is to be understood that the above-described embodiments are intended to illustrate rather than limit the disclosure. Variations may be made to the embodiments without departing from the spirit of the disclosure as claimed. The above-described embodiments illustrate the disclosure but do not restrict the scope of the disclosure.

What is claimed is:

1. A speaker comprising:

a sound wave generator comprising a carbon nanotube structure and an insulative reinforcement structure, wherein the insulative reinforcement structure encloses the entire carbon nanotube structure therein, and the insulative reinforcement structure is a planar structure with a thickness in a range from about 10 nm to about 200 μm;

at least one first electrode and at least one second electrode electrically connected to the sound wave generator;

an amplifier circuit electrically connected to the at least one first electrode and the at least one second electrode; and a connector electrically connected to the amplifier circuit.

2. The speaker of claim 1, wherein the insulative reinforcement structure penetrates into the carbon nanotube structure.

3. The speaker of claim 1, wherein the at least one first electrode and the at least one second electrode are enclosed in the insulative reinforcement structure.

4. The speaker of claim 3, wherein the amplifier circuit and the connector are enclosed in the insulative reinforcement structure, and an input port of the connector is exposed.

5. The speaker of claim 1, wherein a heat capacity per unit area of the planar insulative reinforcement structure is less than $2\times10^{-4}$ J/m$^2$*K.

6. The speaker of claim 1, wherein the planar insulative reinforcement structure defines a plurality of openings.

7. The speaker of claim 6, wherein the openings are blind holes, and each blind hole extends from a surface of the planar insulative reinforcement structure to a surface of the carbon nanotube structure.

8. The speaker of claim 6, wherein the openings are through holes, and each through hole extends from a surface of the planar insulative reinforcement structure to an opposite surface of the planar insulative reinforcement structure.

9. The speaker of claim 1, wherein the insulative reinforcement structure comprises of a material that is selected from the group consisting of glass, metallic oxide, resin and ceramic.

10. The speaker of claim 1, wherein a heat capacity per unit area of the carbon nanotube structure is less than $2\times10^{-4}$ J/m$^2$*K.

11. The speaker of claim 1, wherein the carbon nanotube structure is a carbon nanotube film structure, and the carbon nanotube film structure comprises a plurality of carbon nanotubes substantially oriented along a same direction.

12. The speaker of claim 11, wherein the carbon nanotubes of the carbon nanotube film structure are joined end-to-end by van der Waals attractive force therebetween.

13. The speaker of claim 1, wherein the carbon nanotube structure is a carbon nanotube film structure, and the carbon nanotube film structure comprises a plurality of carbon nanotubes entangled with each other.

14. The speaker of claim 1, wherein the carbon nanotube structure is a carbon nanotube film structure, and the carbon nanotube film structure comprises a plurality of carbon nanotubes resting upon each other, an angle between an alignment direction of the carbon nanotubes and a surface of the carbon nanotube film structure ranges from about 0 degrees to about 15 degrees.

15. The speaker of claim 1, wherein the carbon nanotube structure comprises a single linear carbon nanotube structure, the single linear carbon nanotube structure is folded or winded to form a planar structure.

16. The speaker of claim 1, wherein the carbon nanotube structure comprises a plurality of linear carbon nanotube structures.

17. A speaker comprising:

a sound wave generator comprising a carbon nanotube structure and an insulative reinforcement structure, wherein the carbon nanotube structure comprises a plurality of carbon nanotubes joined end to end by van der Waals attractive force therebetween and defines a plurality of micropores between the carbon nanotubes, and wherein the insulative reinforcement structure comprises a plurality of particles dispersed in the micropores and is a planar structure with a thickness in a range from about 10 nm to about 200 μm;

at least one first electrode and at least one second electrode electrically connected to the sound wave generator;

an amplifier circuit electrically connected to the at least one first electrode and the at least one second electrode; and a connector electrically connected to the amplifier circuit.

18. A speaker comprising:

a sound wave generator comprising a carbon nanotube structure and an insulative reinforcement structure, wherein the carbon nanotube structure comprises a plurality of carbon nanotubes joined end to end by van der Waals attractive force therebetween, and wherein the insulative reinforcement structure comprises a plurality of particles attached on a surface of the carbon nanotubes and is a planar structure with a thickness in a range from about 10 nm to about 200 μm;

at least one first electrode and at least one second electrode electrically connected to the sound wave generator;

an amplifier circuit electrically connected to the at least one first electrode and the at least one second electrode; and a connector electrically connected to the amplifier circuit.

* * * * *